US010534254B2

(12) United States Patent
Yin et al.

(10) Patent No.: US 10,534,254 B2
(45) Date of Patent: Jan. 14, 2020

(54) PHOTOCATALYTIC COLOR SWITCHING OF REDOX IMAGING NANOMATERIALS OF REWRITABLE MEDIA

(71) Applicants: Yadong Yin, Riverside, CA (US); Wenshou Wang, Riverside, CA (US)

(72) Inventors: Yadong Yin, Riverside, CA (US); Wenshou Wang, Riverside, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 273 days.

(21) Appl. No.: 15/520,660

(22) PCT Filed: Oct. 20, 2015

(86) PCT No.: PCT/US2015/056425
§ 371 (c)(1),
(2) Date: Apr. 20, 2017

(87) PCT Pub. No.: WO2016/064849
PCT Pub. Date: Apr. 28, 2016

(65) Prior Publication Data

US 2017/0315436 A1 Nov. 2, 2017

Related U.S. Application Data

(60) Provisional application No. 62/066,088, filed on Oct. 20, 2014.

(51) Int. Cl.

| | |
|---|---|
| ***G03C 1/705*** | (2006.01) |
| ***G03C 1/64*** | (2006.01) |
| ***G03C 1/73*** | (2006.01) |
| ***G03C 1/74*** | (2006.01) |
| ***G03C 1/775*** | (2006.01) |

(52) U.S. Cl.
CPC ..... *G03C 1/705* (2013.01); *G03C 1/64* (2013.01); *G03C 1/732* (2013.01); *G03C 1/74* (2013.01); *G03C 1/775* (2013.01)

(58) Field of Classification Search
CPC ..... G03C 1/64; G03C 1/705; G03C 1/732; G03C 1/74; G03C 1/775
USPC ..... 430/19, 334, 337, 339
See application file for complete search history.

(56) References Cited

U.S. PATENT DOCUMENTS

| | | | |
|---|---|---|---|
| 3,652,276 A | 2/1972 | Bartlett et al. | |
| 3,791,829 A | 2/1974 | Creter | |
| 4,237,207 A | 12/1980 | Ceintrey | |
| 4,256,614 A | 3/1981 | Taylor | |
| 4,276,370 A | 6/1981 | Taylor | |
| 5,332,654 A | 7/1994 | Simon et al. | |
| 8,349,221 B2 | 1/2013 | Kawamoto et al. | |
| 2004/0258562 A1 | 12/2004 | Mills et al. | |
| 2005/0175562 A1 | 8/2005 | Hadasch et al. | |
| 2007/0029527 A1* | 2/2007 | Mills | G01N 21/78 252/408.1 |

FOREIGN PATENT DOCUMENTS

| | | | |
|---|---|---|---|
| DE | 26 17 588 | A1 | 11/1976 |
| EP | 0 509 540 | A1 | 10/1992 |
| EP | 2687548 | A1 | 1/2014 |
| JP | S53-101415 | A | 9/1978 |
| JP | S63-36225 | A | 2/1988 |
| JP | 2002-535738 | A | 10/2002 |
| JP | 2003-251193 | A | 9/2003 |
| JP | 2005-502047 | A | 1/2005 |
| JP | 2005-194277 | A | 7/2005 |
| JP | 2006-520471 | A | 9/2006 |
| JP | 2005158254 | A | 5/2016 |

OTHER PUBLICATIONS

Office Action dated Mar. 19, 2018 in corresponding European Patent Application No. 15 852 045.2.
International Search Report (PCT/ISA/210) dated Jan. 7, 2016, by the Japanese Patent Office as the International Searching Authority for International Application No. PCT/US2015/056425.
Written Opinion (PCT/ISA/237) dated Jan. 7, 2016, by the Japanese Patent Office as the International Searching Authority for International Application No. PCT/US2015/056425.
Office Action dated Sep. 10, 2018 in corresponding European Patent Application No. 15 852 045.2.
Communication pursuant to Article 94(3) EPC dated Jan. 30, 2019, by the European Patent Office in rresponding European Patent Application No. 15 852 045.2-1107. (3 pages).
Extended European Search Report dated Jun. 28, 2017 in corresponding European Patent Application No. 15852045.2.
J. Garcia-Amorós et al., "Saving paper with switchable ink", Dyes and Pigments, 2014, 106, pp. 71-73.
L. Sheng et al., "Hydrochromic molecular switches for water-jet rewritable paper", Nature Communications, 2014, 5:3044, pp. 1-8.
R. Pardo et al., "Photochromic organic-inorganic hybrid materials", Chem. Soc. Rev., 2011, 40, pp. 672-687.

(Continued)

*Primary Examiner* — John A McPherson
(74) *Attorney, Agent, or Firm* — Buchanan Ingersoll & Rooney PC

(57) ABSTRACT

The production of photocatalytic color switching of redox imaging nanomaterials for rewritable media is disclosed. The new color switching system is based on photocatalytic redox reaction enabling reversible and considerably fast color switching in response to light irradiation. In accordance with an exemplary embodiment, the color switching system can include a photocatalyst and an imaging media. With the assistance of photocatalyst, UV light irradiation can rapidly reduce the redox imaging nanomaterials accompany with obvious color changing, while the resulting reduced system can be switched back to original color state through visible light irradiation or heating in air condition. The excellent performance of the new color switching system promises their potential use as an attractive rewritable media to meet increasing needs for sustainability and environmental protection.

16 Claims, 15 Drawing Sheets

(56) References Cited

OTHER PUBLICATIONS

H. Dong et al., "Organic photoresponse materials and devices", Chem. Soc. Rev., 2012, 41, pp. 1754-1808.
C. D. Wessells et al., "Copper hexacyanoferrate battery electrodes with long cycle life and high power", Nature Communications, 2011, 2:550, pp. 1-5.
K. Szacilowski et al., "Synthesis, structure and photoelectrochemical properties of the TiO2-Prussian blue nanocomposite", J. Mater. Chem., 2006, 16, p. 4603-4611.
W. Wang et al., "Nanocrystalline TiO2-Catalyzed Photoreversible Color Switching", Nano Lett. 2014, 14, pp. 1681-1686.
Office Action dated Sep. 17, 2019, by the Japanese Patent Office in corresponding Japanese Patent pplication No. 2017-522534, with an English translation of the Office Action. 8 pages (Previously submitted in an information Disclosure Statement filed Oct. 15, 2019).

* cited by examiner

"The principles of physics, as far as I can see, do not speak against the possibility of maneuvering things atom by atom. It is not an attempt to violate any laws; it is something, in principle, that can be done; but in practice, it has not been done because we are too big"

---Richard P. Feynman

FIG. 11a

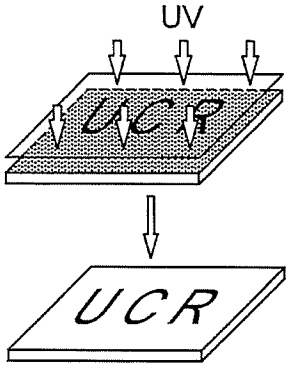

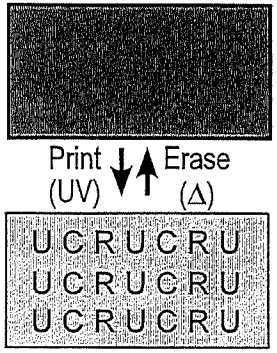

FIG. 11b

"The principles of physics, as far as I can see, do not speak against the possibility of maneuvering things atom by atom. It is not an attempt to violate any laws; it is something, in principle, that can be done; but in practice, it has not been done because we are too big"
—Richard P. Feynman

FIG. 11c

"The principles of physics, as far as I can see, do not speak against the possibility of maneuvering things atom by atom. It is not an attempt to violate any laws; it is something, in principle, that can be done; but in practice, it has not been done because we are too big"
—Richard P. Feynman

FIG. 11d

"The principles of physics, as far as I can see, do not speak against the possibility of maneuvering things atom by atom. It is not an attempt to violate any laws; it is something, in principle, that can be done; but in practice, it has not been done because we are too big"
—Richard P. Feynman

FIG. 11e

"The principles of physics, as far as I can see, do not speak against the possibility of maneuvering things atom by atom. It is not an attempt to violate any laws; it is something, in principle, that can be done; but in practice, it has not been done because we are too big"
—Richard P. Feynman

FIG. 11f

UCR

UCR

UCR

PHOTOCATALYTIC COLOR SWITCHING OF REDOX IMAGING NANOMATERIALS OF REWRITABLE MEDIA

CROSS-REFERENCE TO RELATED APPLICATION

This patent application claims priority to U.S. Provisional Patent Application Ser. No. 62/066,088, filed Oct. 20, 2014, which is incorporated herein by reference in its entirety.

STATEMENT OF GOVERNMENT INTEREST

The disclosure described and claimed herein was made in part utilizing funds supplied by the United States Department of Energy under contract No. DE-FG02-09ER16096 between the United States Department of Energy and The Regents of the University of California. The government has certain rights to the disclosure.

BACKGROUND

The development of new color switching system that reversibly change color in response to external stimuli, such as electric or magnetic field, mechanical stress, temperature change, or chemical reaction, has attracted a great deal of attentions for their important applications in sensing devices, display and signage technologies, rewritable media, and security features.

For example, a particularly intriguing possibility is offered by light-responsive materials, which can be remotely controlled and rapidly changed in a clean and non-invasive manner without the need of direct contact with the system. Many organic compounds that show photoreversible color switching properties, such as some anilines, disulfoxides, hydrazones, osazones, semicarbazones, stilbene derivatives, succinic anhydride, camphor derivatives, o-nitrobenzyl derivatives and spiro compounds. Some of the most common color switching processes involved in the these organic compounds are pericyclic reactions, cis-trans isomerizations, intramolecular hydrogen transfer, intramolecular group transfers, dissociation processes and electron transfers (oxidation-reduction).

Efforts have been devoted to improving the properties of the color switching organic compounds to fulfill the requirements of the different applications. However, the practical application of these organic compounds in sensing devices, display and signage technologies, rewritable media, and security features can have challenges, for example, (i) most of these organic molecules depends strongly on the environment properties in which they are dissolved or allocated, such as the polarity, pH value, solubility, temperature and etc., (ii) organic compounds experience competing thermal back relaxation and sometimes other side reactions which, although slow, are unavoidable and give rise to serious problems such as lack of stability and controllability, leading to low efficiency both in color switching rate and cycling performance, (iii) color switching often becomes much slower when organic compounds are present in solid media instead of solution since their molecular mobility is dramatically restricted, and (iv) high cost associated with the complex synthesis of organic compounds.

SUMMARY

This disclosure discloses the production of photocatalytic color switching of redox imaging nanomaterials for rewritable media. The new color switching system is based on photocatalytic redox reaction enabling reversible and considerably fast color switching in response to light irradiation.

In accordance with an exemplary embodiment, the color switching system comprises a photocatalyst and an imaging media. With the assistance of photocatalyst, UV light irradiation can rapidly reduce the redox imaging nanomaterials accompany with obvious color changing, while the resulting reduced system can be switched back to original color state through visible light irradiation or heating in air condition. In accordance with an exemplary embodiment, the design of this new color switching system (appropriate photocatalyst and redox imaging materials) is of great importance so the color switching can be reversibly transferred between the two constituents upon photo-irradiation.

In accordance with an exemplary embodiment, a reversible color switching system is disclosed, comprising: a redox imaging material; and a photocatalyst, which photocatalyzes the imaging material to produce a photocatalytic redox reaction enabling reversible and color switching in response to light irradiation.

In accordance with an exemplary embodiment, a method of photocatalytic color switching of redox imaging materials for rewritable media is disclosed, the method comprising: irradiating a redox imaging material having a photocatalyst with UV light to produce a photocatalytic redox reaction on the redox imaging material.

BRIEF DESCRIPTION OF THE DRAWINGS

The disclosure is explained below with reference to the exemplary embodiments shown in the drawings. In the drawings:

FIG. 11 shows printing, erasing and legibility of letters on the rewritable paper, wherein (a) Schematic representation of writing letters on the rewritable paper using photomask on UV light irradiation, (b) digital images of writing and erasing letters on the rewritable paper, (c-f) digital images of rewritable paper maintaining in ambient air after writing of (c) 10 min, (d) 1 day, (e) 3 days and (f) 5 days. Scale bars, 5 mm. The photomask was produced by ink-jet printing on a plastic transparency. The slight variation in the background was due to the uneven thickness of the film resulted from the manual drop casting.

DETAILED DESCRIPTION

When photocatalyst absorbs UV radiation from sunlight or illuminated light source, it will produce pairs of electrons and holes. The excess energy of this excited electron promoted the electron to the conduction band of titanium oxide and therefore creating the negative-electron (e−) and positive-hole ($h_+$) pair. The positive-hole of titanium oxide breaks apart the water molecule to form hydroxyl radical while the negative-electron reacts with oxygen molecule to form superoxide anion. Photo-electrons can be generated from photocatalyst under light irradiation, which can be utilized to reduce redox materials with obvious color changing. The photocatalyst can include binary metal oxides ($TiO_2$, ZnO, $SnO_2$, $WO_3$, $Nb_2O_5$, and $ZrO_2$) and sulfides (CuS, ZnS, CdS, SnS, $WS_2$ and $MoS_2$). Among the most promising inorganic photocatalyst, titanium oxide ($TiO_2$) can offer the advantages of high photocatalytic activity, proper band-edge positions, superior photo-chemical and thermal stability, high fatigue resistance, low-cost and non-toxicity.

Figure 1:
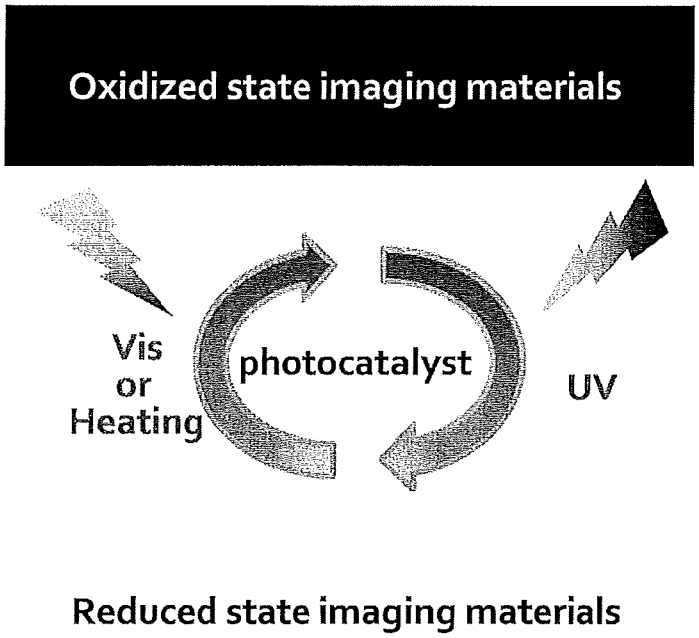
FIG. 1 shows the schematic illustration of the reversible color switching between redox imaging materials photocatalyzed by photocatalyst nanoparticles in accordance with an exemplary embodiment.
Figure 2:
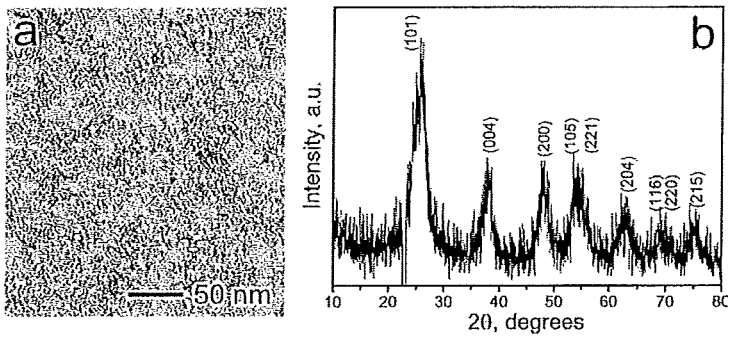
FIG. 2 shows (a) TEM image, (b) XRD, and (c) UV-Vis spectrum of $TiO_2$ nanoparticles prepared by a high temperature hydrolysis reaction, and wherein the inset in (c) shows a digital photograph of a concentrated aqueous dispersion of the $TiO_2$ nanocrystals in a glass vial.

FIG. 2 shows the results of $TiO_2$ nanoparticles prepared by a high temperature hydrolysis reaction. The size of $TiO_2$ nanoparticles developed in this disclosure is from approximately 5 to 100 nm. The phase of $TiO_2$ nanoparticles contains amorphous, anatase, rutile, and brookite.

Redox material with oxidation-reduction reaction can undergo a definite color changing at a specific electrode potential, which are a promising ingredient as imaging media to construct new color switching system. Fundamentally, oxidation-reduction (or redox) reactions are a type of chemical reaction that involves a transfer of electrons between two species. Redox reactions are comprised of two parts, a reduced half and an oxidized half, that always occur together, in which the oxidation number of a molecule, atom, or ion changes by gaining or losing an electron.

Commercial redox dyes can be used as imaging media in the new color switching system since they have a potential of reversible colored-decolored redox reaction. The commercial redox dyes can contain methylene blue (color of oxidized form: blue and color of reduced form: colorless), methylene green (green and colorless), neutral red (red and colorless), acid green (green and light yellow), safranin T (red-violet and colorless), phenosafranin (red and colorless), indigomono sulfoinic acid (blue and colorless), indigo carmine (blue and colorless), indigotrisulfonic acid (blue and colorless), indigotetrasulfonic acid (blue and colorless), thionine (violte and colorless), sodium o-cresol indophenol (blue and colorless), sodium 2,6-dibromophenol-indophenol (blue and colorless), 2,2'-bipyridine(Ru complex) (colorless and yellow), 2,2'-bipyridine(Fe complex) (cyan and red), nitrophenanthroline (cyan and red), n-phenylanthranilic acid (violet-red and colorless), 1,10-phenathroline iron(II) sulfate complex (cyan and red), n-ethoxychrysoidine (red and yellow), 5,6-dimethylphenanthroline (Fe complex) (yellow-green and red), o-dianisidine (red and colorless), sodium diphenylamine sulfonate (red-violet and colorless), diphenylbenzidine (violet and colorless), diphenylamine (violet and colorless), viologen (colorless and blue). In addition, the new color switching systems based on three basic colors with red (neutral red), green (methylene green) and blue (methylene blue) (RGB) can function as three primary color switching system for constructing various color switching systems showing various color.

Figure 3:
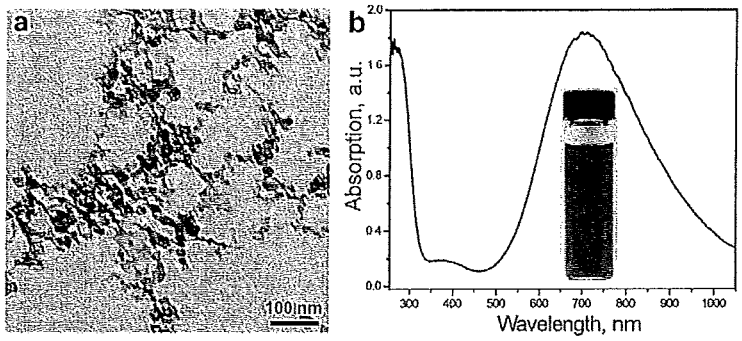
FIG. 3 shows (a) a TEM image and (b) UV-Vis absorption spectrum of Prussian Blue nanoparticles.

The second type of imaging media is the transition metal hexacyanometallates with a general formula $A_xM_y[M'_z(CN)_6]n.mH_2O$, where A may be alkali metal ions, alkaline earth ions, ammonium ions, or combinations thereof, and M and M' are transition metal ions, as well as various amount of water ($H_2O$) within the crystal structure. Prussian blue and its analogues are the typical metal hexacyanometallates, which has attracted attention due to its various applications in sensors for non-electroactive cations, transducers for hydrogen peroxide, enzyme-based biosensors, electrochromic devices, ion exchange media, electrocatalysis, photoelectrochemical/photocatalytic devices, and batteries. For Prussian blue, the Fe3+ ions are octahedrally coordinated to the nitrogen ends of the CN— groups, and the Fe2+ ions to their carbon ends. On the insertion of extra K+ ions, there is a corresponding reduction of some of the nitrogen-coordinated $Fe3_+$ ions, with a change in color from deep blue to colorless, creating a product called Everitt's Salt. Prussian Blue may also be oxidized by removing the potassium ions. In this case, the carbon-coordinated $Fe2_+$ ions can become oxidized, and the product is called Prussian yellow. The metal hexacyanometallates using as redox imaging media contains metal hexacyanoferrate and hexacyanocobaltate with transition metal ions of Mn, Fe, Co, Ni, and Cu. FIG. 3 shows the typical size and color of Prussian blue. The size of metal hexacyanometallates is from 5 to 500 nm.

Transition metal ions, for example, such as V, Cr, Mn, Fe, Co, Ni, Cu, Mo, W, Ag, etc., can exhibit intervalence charge transfers under reduction and oxidation reactions, in which the electrons transfer occurs between these ions with different valences. The charge-transfer transition between these different reduction and oxidation states means that the metal ions will show different colors. The mixture of using photocatalyst (such as $TiO_2$) with at least one transition metal ion can be used as redox imaging media. In addition, transition metal ion-doped $TiO_2$ nanoparticles can also be used as redox imaging media. Upon light irradiation, the photocatalyst will create photo-generated electron-hole pairs, in which the photo-generated electrons will reduce the transition metal ion to transition metal nanoparticles, resulting in different color. Transition metal nanoparticles can switch back to original ionic state by oxidation with oxygen.

In accordance with an exemplary embodiment, improving the charge separation between photogenerated holes and electrons can be the key step to realizing fast and reversible color switching of the new color switching system constructed by photocatalysis and redox imaging materials. In accordance with an exemplary embodiment, various surfactants were utilized as a capping ligand to bind on the photocatalysis's surface, which also act as an effective sacrificial electron donor to scavenge the photogenerated holes. The leaving photo-generated electrons will effectively reduce redox imaging media to achieve color switching. The capping ligand contains poly(ethylene glycol)-b-poly(propylene glycol)-b-poly(ethylene glycol), Brij 35 and Span 80.

To move towards realistic technological implementations of these color switching systems constructed by photocatalysis and redox imaging medias, the materials selected can be processed as thin film, coatings, and other suitable forms, as needed from engineering considerations. As for thin films, various substrates, such as glass, plastic and paper can be used. Some gelling and thickening polymers, such as PVA, PVP, hydroxyethyl cellulose, hydroxypropyl cellulose and the like can be used. Some smoothing agents, such as ethylene glycol, diethylene glycol, can be used to produce a solid film with a homogeneous color and a smooth surface.

Figure 4A:
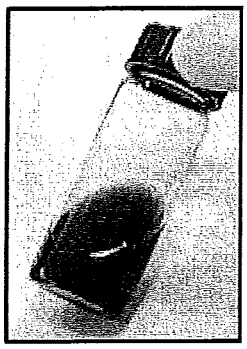
FIG. 4 shows fabrication of $TiO_2$ nanoparticles/MB/HEC solid film, and wherein (a) aqueous mixture of $TiO_2$ nanocrystals/MB/HEC/EG, (b) schematic illustration of preparing solid film by drop casting aqueous mixture of $TiO_2$ nanoparticles/MB/HEC/EG onto glass or plastic substrates, (c) digital photo of $TiO_2$ nano nanoparticles/MB/HEC/EG solid film on glass substrates. Scale bar: 5 mm.
Figure 4B:
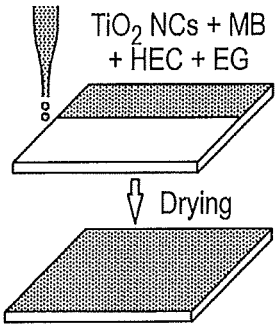
Figure 4C:
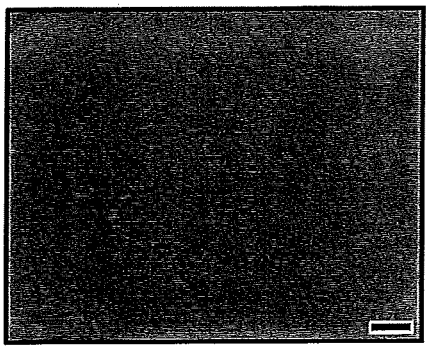

FIG. 4 shows an example of the fabrication process of $TiO_2$ nanoparticles/MB/HEC solid film.

In accordance with an exemplary embodiment, printing letters and patterns in the solid film can be achieved by UV light irradiation. In one demonstration, letters and patterns can be printed through a photomask, which was pre-produced by ink-jet printing on a plastic transparency.

Figures 5A, 5B:
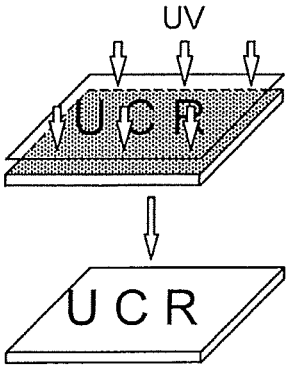
FIG. 5 shows a (a) schematic representation of writing letters on rewritable paper using photomask upon UV light irradiation, and (b) digital images of writing letters on rewritable paper.

FIG. 5 shows schematic representation of writing letters on rewritable paper using photomask upon UV light irradiation, and digital images of writing letters on rewritable paper. The letters and patterns can also be printed directly by using focused UV light beam. The prints can be erased completely by heating the solid film at high temperature, for example, such as 40-160° C. in air. Electrical field can also be used to erase the prints by re-oxidizing the imaging layer. The prints can be eased by chemical agents with oxidation property, such as hydrogen peroxide, ammonium persulfate, and potassium permanganate.

Rewritable Media Constructed by $TiO_2$ Nanoparticles and Methylene Blue.

Figure 6A:
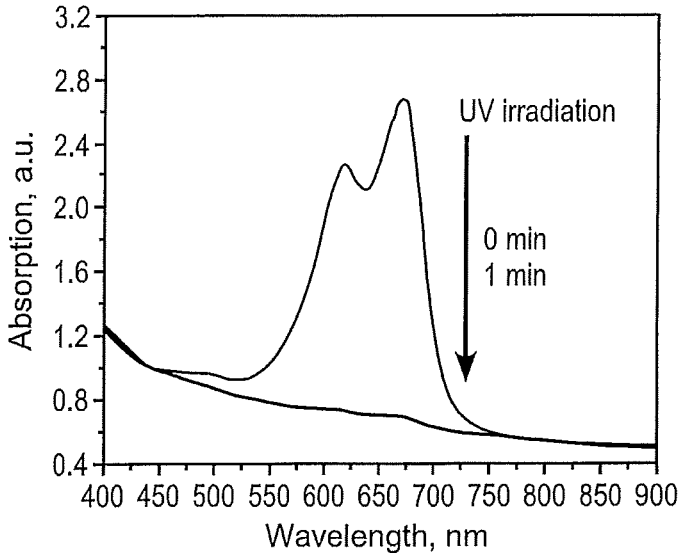
FIG. 6 shows reversible color switching of the rewritable media based on $TiO_2$ nanoparticles and methylene blue, wherein (a) UV-Vis spectra showing the decoloration process under UV irradiation, (b) UV-Vis spectra showing the recoloration of the film at room temperature under ambient air, (c) UV-Vis spectra showing the recoloration process upon heating at 115° C. in air, and (d) the absorption intensity of a solid film recorded continuously in 20 cycles of switching between color and colorless states.
Figure 6B:
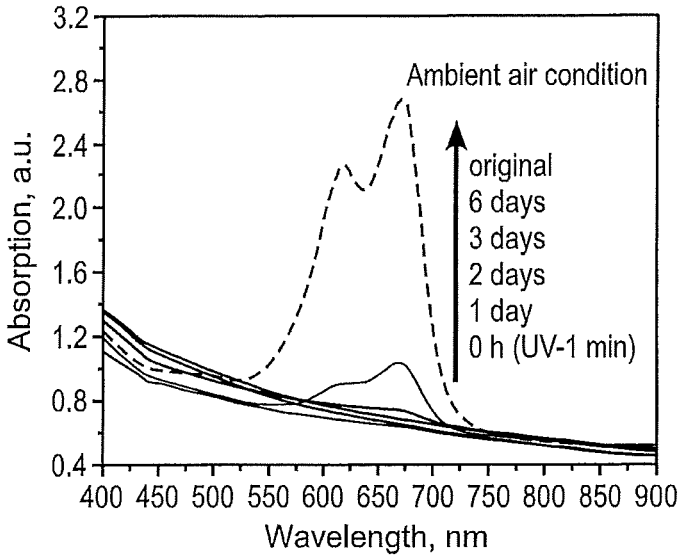
Figure 6C:
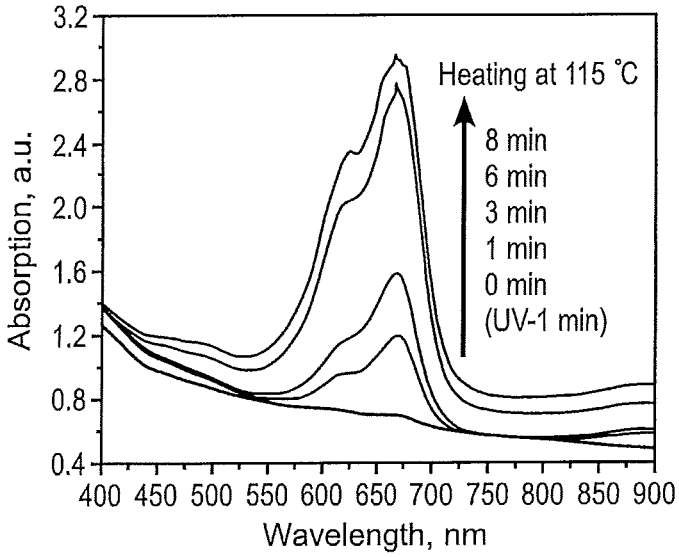
Figure 6D:
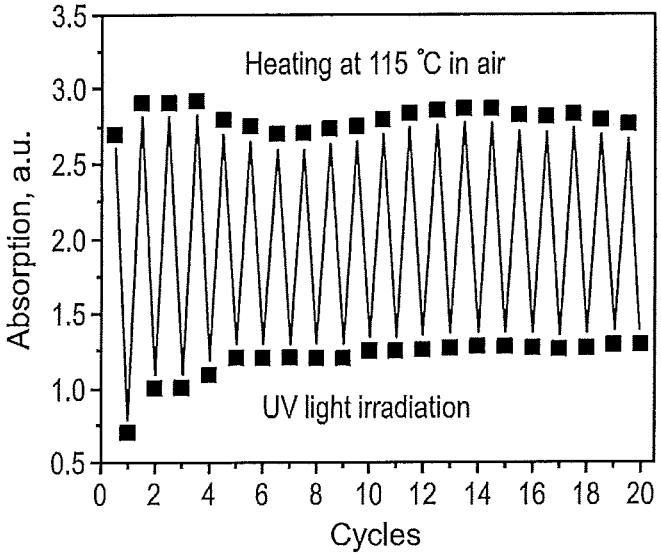

$TiO_2$/MB/HEC solid film was prepared by drop casting a mixed aqueous solutions of methylene blue, $TiO_2$ nanoparticles, HEC and EG on a glass or plastic substrate. As shown in FIG. 6*a*, the absorption peak of solid film (main peak at approximately 660 nm) disappeared completely after 1 minute of UV irradiation, indicating that blue colored MB switched to colorless Leuco methylene blue (LMB). Under ambient condition, the colorless solid film can maintain its reduced state for at least 3 days, and it took 6 days to re-oxidize only 20% LMB back to MB (FIG. 6*b*). As shown in FIG. 6*c*, when the colorless solid film containing LMB was heated in air at 115° C., the absorption of MB monomers at approximately 660 nm gradually increased, and fully recovered to the original intensity after 8 minutes. In accordance with an exemplary embodiment, the reversibility and repeatability of the same solid film under two different states have been investigated. The $TiO_2$/MB/HEC solid film can be photo-switched between blue color and colorless for more than 20 consecutive cycles (FIG. 6*d*). Throughout the 20 cycles, the $TiO_2$/MB/HEC solid film remained essentially unchanged without the formation of any cracks or aggregations.

Rewritable Media Constructed by $TiO_2$ Nanoparticles and Prussian Blue.

Figure 7A:
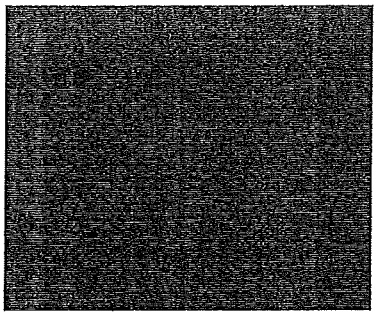
FIG. 7 shows printing and legibility of letters on the rewritable media based on $TiO_2$ nanoparticles and Prussian blue shows, and wherein (a-d) are digital images of the $TiO_2$/PB/HEC solid films (a) and writing letters on the rewritable media maintaining in ambient air after writing of (b) 10 minutes, (c) 1 day, and (d) 2 days. Scale bars: 5 mm.
Figure 7B:
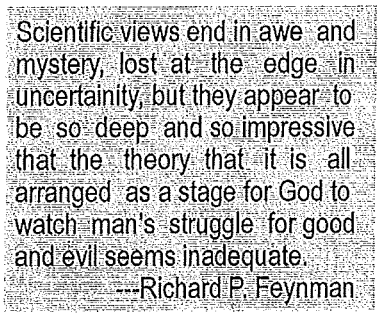
Figure 7C:
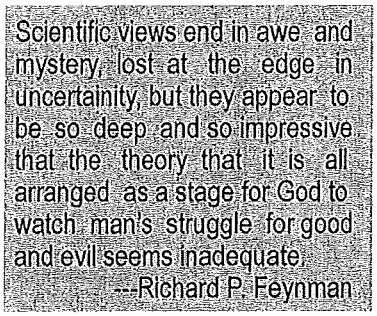
Figure 7D:
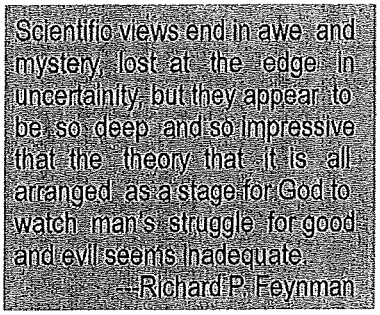

$TiO_2$/PB/HEC solid film with a homogeneous blue color and a smooth surface was prepared by a similar drop casting method on a glass, plastic or paper substrate (FIG. 7*a*). As a demonstration, letters were printed in the solid film by UV light irradiation through a photomask, which was pre-produced by ink-jet printing on a plastic transparency. After UV irradiation for approximately 2 minutes, the exposed regions turned to white while the unexposed regions retained the blue color, replicating letters from the photomask to the film, as shown in FIG. 7*b*. Blue letters of font size 11 with very good resolution could be easily achieved, and they remained highly legible for at least 2 days under ambient condition (FIGS. 7*c* and 7*d*), which is sufficiently long for most of the temporary reading purposes. In accordance with an exemplary embodiment, the prints can be erased completely by heating the rewritable paper at, for example, 115° C. in air for approximately 10 min.

Rewritable Media Constructed by Cu-Doped $TiO_2$ Nanoparticles.

Figure 8A:
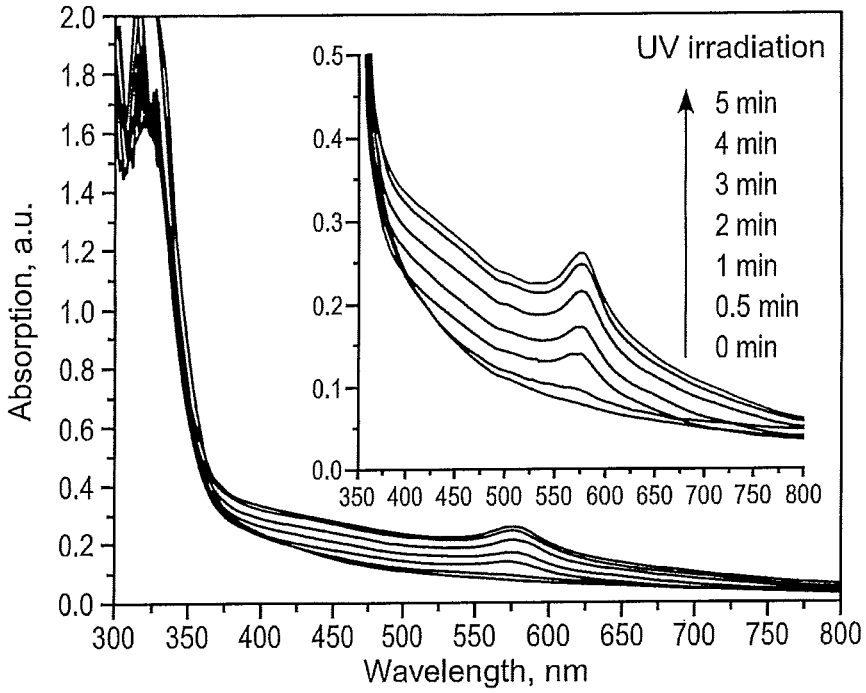
FIG. 8 shows reversible color switching of the rewritable media based on Cu-doped $TiO_2$ nanoparticles, wherein (a) UV-Vis spectra of Cu-doped $TiO_2$ nanoparticles/HEC solid film showing the coloration process under UV irradiation, (b) UV-Vis spectra showing the decoloration process under heating in air, and (c) a plot of the absorption at 576 nm versus the number of cycles of repeating color switching of the solid film.
Figure 8B:
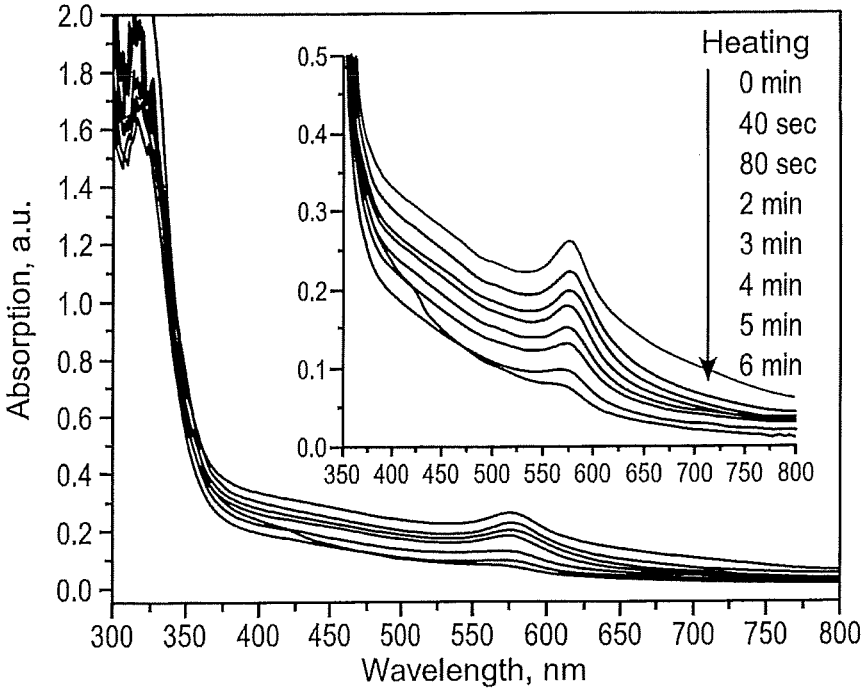
Figure 8C:
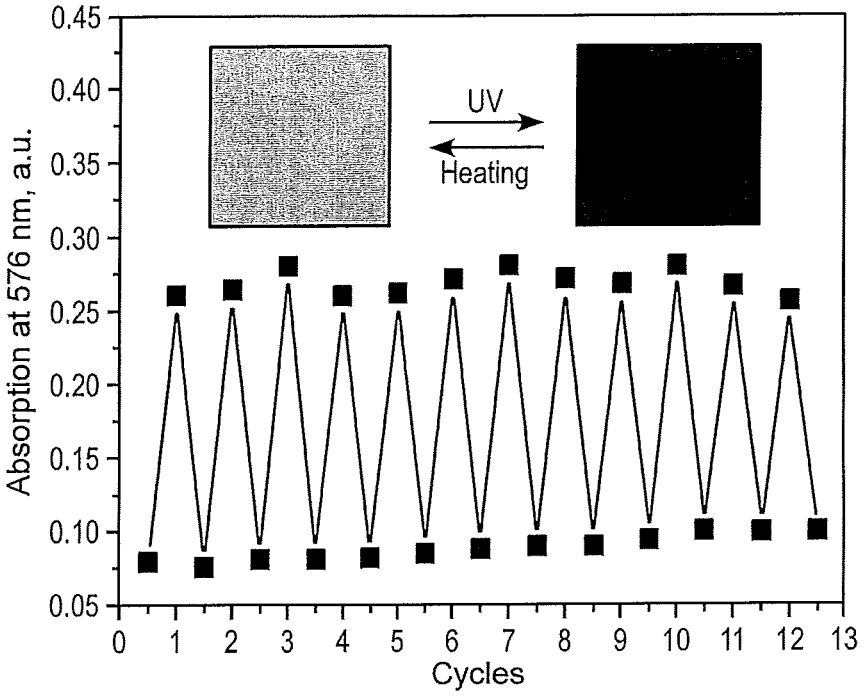

A mixture of Cu-doped $TiO_2$ nanoparticles, HEC, EG and water was drop casted on a glass, plastic or paper substrate and dried to form a solid film. The solid film can be switched between colorless and brown color. In accordance with an exemplary embodiment, the absorption intensity of the solid film gradually increases and an absorption peak (approximately 576 nm) appears upon UV light irradiation with 5 min (FIG. 8*a*), in consistent with the color of solid film changing from light-yellow to dark-brown (inset in FIG. 8*c*). As shown in FIG. 8*b*, when the dark-brown solid film was heated in air at 70° C., the absorption intensity gradually decreased, and fully recovered to the original intensity after approximately 6 minutes. Without heating, the color can also disappear completely but with a long time of approximately 12 hour. The reversibility and repeatability of the same solid film under two different states have been investigated. As shown in FIG. 8*c*, it was found that no obvious decrease in color intensity but rather just regular fluctuations is observed after more than dozens of consecutive coloring-decoloring cycles. Throughout the dozens of cycles, the solid film remained essentially unchanged without the formation of any cracks or aggregations.

Rewritable Media Constructed by $TiO_2$ Submicroparticles and Redox Imaging Materials The rewritable media can also realized by using $TiO_2$ submicroparticles with sizes from, for example, approximately 100 to 500 nm as photocatalyst and redox imaging materials. The oxidized imaging materials can switch rapidly to its reduced state under UV irradiation, suggesting the effective photocatalytic reduction of imaging materials by $TiO_2$ submicroparticles. In accordance with an exemplary embodiment, reduced of imaging materials switched back to original oxidized state completely under ambient conditions by visible light irradiation or heating.

Rewritable Media Constructed by $ZrO_2$ Nanoparticles and Redox Imaging Materials.

In accordance with an exemplary embodiment, the rewritable media can also prepared by using other semiconductor as photocatalyst, such as $ZrO_2$ nanoparticles, and redox imaging materials as imaging layer. The decoloration can be mainly driven by the reduction reaction of redox imaging materials by photogenerated electrons from $ZrO_2$ nanoparticles under UV irradiation, and the recoloration process operates by the oxidation reaction of redox imaging materials with $O_2$, which can be promoted by visible light irradiation or heating.

Photocatalytic Color Switching of Redox Dyes for Ink-free Light Printable Rewritable Paper In accordance with an exemplary embodiment, the invention of paper as writing materials has greatly contributed to the development and spread of civilization. However, its large-scale production and usage have also brought significant environment and sustainability problems to modern society. To reduce paper production and consumption, it is highly desirable to develop alternative rewritable media that can be used multiple times. Herein, the fabrication of a rewritable paper is disclosed based on color switching of commercial redox dyes using titanium oxide-assisted photocatalytic reactions. The resulting paper does not require additional inks and can be efficiently printed using ultraviolet light and erased by heating over 20 cycles without significant loss in contrast and resolution. The legibility of prints can retain over several days. This rewritable paper represents an attractive alternative to regular paper in meeting the increasing global needs for sustainability and environmental protection.

Although we now live in an age dominated by electronic media, paper still plays a very important role in communication and information storage, as evidenced by its tripled global consumption over the past three decades. According to recent international surveys, 90% of all information in businesses is currently retained on paper; however, most of the prints are disposed after only one-time reading, which not only significantly increases business operating cost on both paper and ink cartridges but also creates huge environmental problems including deforestation, solid waste and chemical pollution to air, water and land. Rewritable paper that can be used multiple times and does not require additional inks for printing is therefore an attractive alternative that can have enormous economic and environmental merits to modern society.

Conventionally, organic dyes capable of undergoing reversible color switching based on the photoisomerization of constitute chromophores were proposed for potential use as the imaging layer in rewritable printing media. However, only limited progresses have been made in this area because of some major challenges: (i) color switching often becomes much slower when dyes are present in solid media instead of solution, as their molecular mobility is markedly restricted, (ii) many switchable dyes retain their color for only several hours under ambient conditions, which is too short for reading, (iii) the toxicity of switchable dyes is often an issue for daily use and (iv) most switchable dyes involve complex synthesis and are therefore expensive. As a result, it is of high interest to develop rewritable papers based on new color switching mechanisms.

Redox dyes can reversibly change color on redox reactions. Redox dyes may serve as promising imaging media for the development of rewritable paper if their redox reactions can be manipulated properly. Methylene blue (MB), for example, can be switched between blue color in an oxidizing environment and colorless (leuco form, LMB) in a reducing environment. It is a dye of low toxicity broadly used in biology and medicine, with typical applications include being an antidote for cyanide and, most commonly, in vitro diagnostic in biology, cytology, haematology, and histology. It has been found that $TiO_2$, a photocatalytically active material, could be used to enable the decoloration of MB under UV irradiation. In this case, additional reducing agents, such as ascorbic acid, were usually used as sacrificial electron donor (SED) to scavenge the holes produced from the excitation of $TiO_2$ under UV irradiation, and leave photo-generated electrons for reducing MB to LMB in solution. However, there is no report about using $TiO_2$ and MB as an imaging layer for the fabrication of light switchable rewritable paper, because the recoloration process could not be initiated by any convenient means due to the presence of excessive reducing agents in the system.

$TiO_2$ nanocrystals capped with appropriate ligands have been recently used to promote the decoloration of an aqueous solution of MB from blue to colorless under UV irradiation, and the system can recover to its original blue color on visible light irradiation. The decoloration is mainly driven by the reduction of MB to LMB by photo-generated electrons from $TiO_2$ nanocrystals under UV irradiation, and the recoloration process operates by the $TiO_2$-induced self catalysed oxidation of LMB by ambient $O_2$ under visible irradiation. Compared with photoisomerizable chromophores, the $TiO_2$/MB/water system can rapidly switch color with high reversibility and excellent repeatability. It also has the merits of low toxicity and low cost as both $TiO_2$ particles and MB have already been widely used in cosmetic, medical and other industries. However, the spontaneous recoloration process under visible light makes this system incompatible with its potential use as an imaging layer in the rewritable paper. Indeed, simply depositing the solution of $TiO_2$ nanocrystals and MB on a solid substrate led to a flaky film, which, after decoloration by UV, can only remain colorless for less than 6 hours, mainly due to the quick oxidation of LMB by ambient oxygen. For using as the imaging layer in the rewritable paper, a new mechanism is highly desirable to effectively stabilize the LMB and maintain the colorless state for significantly longer periods.

For a redox dye-based rewritable paper, the recoloration should be slow enough to retain the printed information under ambient conditions, but sufficiently fast when external stimulation for switching is applied. In accordance with an exemplary embodiment, the fabrication of a solid composite film to which letters and patterns can be repeatedly printed using UV light, retained for days and then erased by simple heating is disclosed. The imaging layer of the rewritable film is composed of $TiO_2$ nanocrystals, a redox dye, and hydroxyethyl cellulose (HEC). In accordance with an exemplary embodiment, rewritable paper can be erased and rewritten 420 times with no significant loss in resolution. In addition, rewritable paper with three primary colors (blue, red and green) can be produced by using various commercial redox dyes, such as MB, neutral red (NR) and acid green (AG). The excellent performance of these novel rewritable paper promises their potential use as an attractive alternative to a regular paper to meet our society is increasing needs for sustainability and environmental protection.

Photocatalytic Color Switching

Figure 9:
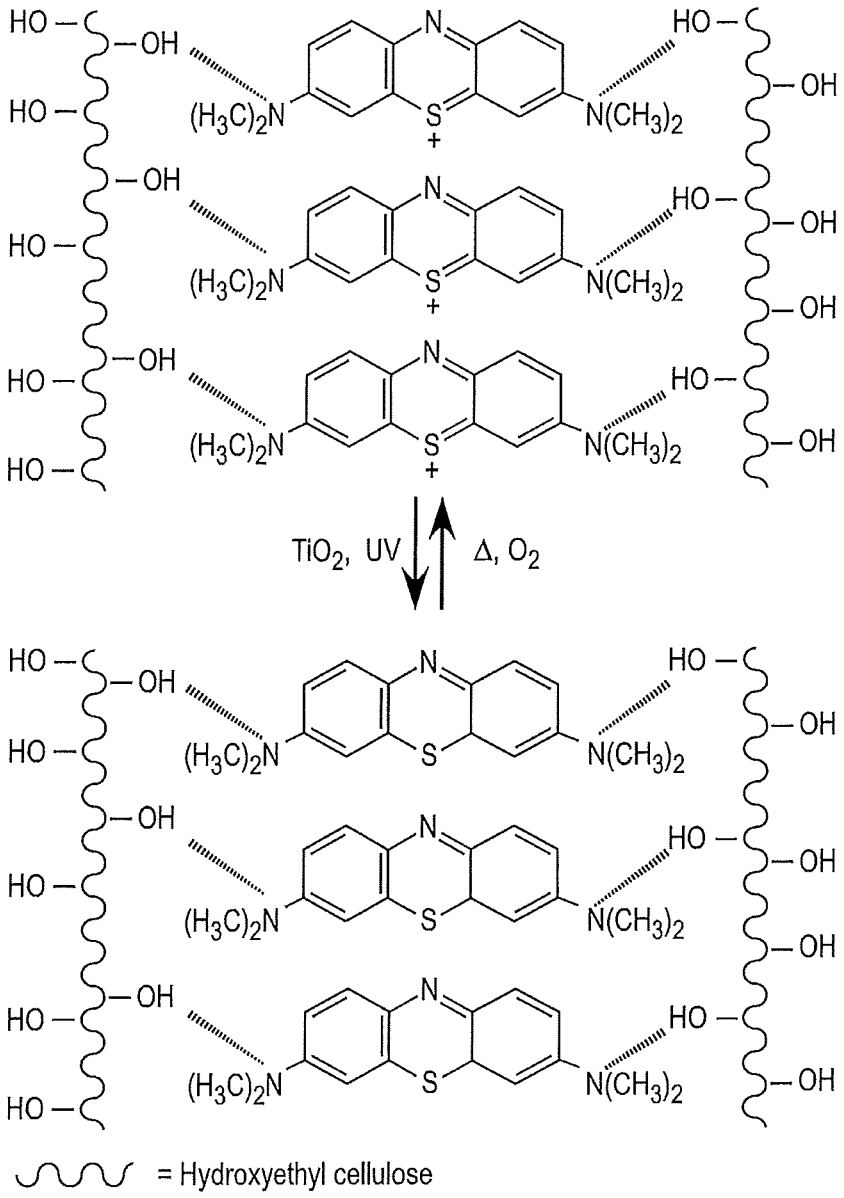
FIG. 9 shows reversible redox reactions involved in the color switching of a $TiO_2$/MB/HEC composite film, wherein MB (blue, oxidized form) and LMB (colorless, reduced form) molecules are stabilized by surrounding HEC molecules through hydrogen bonding. The chloride ion is omitted in the molecular structure of MB.

In accordance with an exemplary embodiment, the basic reactions involved in printing and erasing are the reduction and oxidation of MB. The reduction reaction is photocatalytically initiated by $TiO_2$ nanocrystals under UV irradiation. The $TiO_2$ nanocrystals with diameter of a few nanometres were synthesized through a high-temperature hydrolysis reaction in the presence of a nonionic polymeric capping ligand poly(ethylene glycol)-b-poly(propylene glycol)-b-poly(ethylene glycol) (P123), which binds to the nanocrystal surface and acts as an effective SED to scavenge holes generated from the photoexcited $TiO_2$ nanocrystals. UV irradiation of the film therefore can produce sufficient electrons for rapid reduction of blue MB to its colorless leuco form. The key challenge here is the prevention of rapid spontaneous oxidation of LMB by ambient oxygen so that the printed information can be retained legible for a reasonably long period. HEC was chosen to address this issue, as it not only chemically stabilizes the LMB through hydrogen bonding but also reduces the diffusion of ambient oxygen (FIG. 9). Adding HEC to the mixture containing $TiO_2$ nanocrystals and MB led to a smooth film that can retain the photoprinted mark for 43 days under ambient conditions, making the system practically useful for the fabrication of rewritable paper.

Color switching tests of $TiO_2$/MB solid film were conducted first by directly drying $TiO_2$ nanocrystals/MB/water solution on a glass substrate. The absorption spectrum of the solid film appeared very different from that of the aqueous mixture, in which the absorption at approximately 660 nm decreased while the absorption at approximately 590 nm increased drastically, indicating the conversion of monomers of MB to dimers (and some trimers) due to the increased MB concentration during drying. The blue colored MB switched rapidly to colorless LMB under UV irradiation, suggesting the effective photocatalytic reduction of MB by $TiO_2$ nanocrystals. As expected, LMB switched back to MB completely under ambient conditions in less than 6 hours, making the system difficult for practical applications in the rewritable paper.

In accordance with an exemplary embodiment, HEC can significantly slowdown the oxidation process. The stabilization effect can be attributed to the hydrogen bonding between the abundant —OH groups on HEC molecules and the —$N(CH_3)2$ groups on MB and LMB, as schematically shown in FIG. 9. In accordance with an exemplary embodiment, the finding can be supported by an earlier report by Nakata et al., although therein the interaction between HEC and MB was believed to be electrostatic. The stabilization effect can also be found even in solution, where introducing HEC to an MB solution can promote the transition of MB monomers to their dimeric form, as evidenced by the progressive enhancement in the intensity of the peak at approximately 610 nm with increasing concentration of HEC in the solution. After mixing MB, $TiO_2$ nanocrystals, HEC and EG homogenously in water, the mixture remained a stable blue dispersion and no precipitation could be observed even after 3 months. HEC also greatly helped with the film formation: the mixture could be conveniently drop casted on a glass or plastic substrate and produce a solid film with a homogeneous blue color and a smooth surface, which remained unchanged in topography even after being heated to 150° C. In addition, HEC has been widely used in cosmetics and household products as a gelling and thickening agent due to its low toxicity and cost. The introduction of HEC also helps in preventing potential exposure of human body directly to dyes, again benefiting the practical usage of the system.

Reversibility and Repeatability

In accordance with an exemplary embodiment, Incorporating HEC into $TiO_2$/MB/HEC solid film did not show obvious effect on the decoloration rate under UV light irradiation, further indicating the effectiveness of the photoexcited $TiO_2$ nanocrystals in reducing MB. As shown in FIG. 6*a*, the absorption peak of solid film (main peak at approximately 660 nm) disappeared completely after 1 min of UV irradiation. However, it took 6 days to re-oxidize 20% LMB back to MB under ambient conditions, which was substantially slower than the case without HEC (FIG. 6*b*). It is therefore clear that HEC can greatly inhibit the oxidation of LMB, making the system compatible with the needs in practical applications.

In contrast, although the stabilization effect of HEC is very effective at ambient conditions, heating the colorless solid film in air at 115° C. can markedly enhance the recoloration rate. As shown in FIG. 6*c*, when the colorless solid film containing LMB was heated in air at 115° C., the absorption of MB monomers at approximately 660 nm gradually increased and fully recovered to the original intensity after 8 min. In accordance with an exemplary embodiment, the heating process also indicates that monomer-to-dimer conversion is an exothermic process: after cooling in air for approximately 40 min, some of the MB monomers converted to dimers again with absorption peak partially shifting from approximately 660 nm to approximately 610 nm. The reversibility and repeatability of the same solid film under two different states have been investigated. As shown in FIG. 6*d*, it was found that only a slight decrease in color intensity was observed after 20 consecutive writing-erasing cycles. Throughout the 20 cycles, the $TiO_2$/MB/HEC solid film remained essentially unchanged without the formation of any cracks or aggregations. It can be noted that rewriting cycle number of 20 represents a big step forward comparing with the existing systems.

In accordance with an exemplary embodiment, the systems as disclosed can still operate for many more cycles beyond 20 times, although it is expected that their performance will eventually decay due to the consumption of the SED molecules. For example, by slightly increasing the amount of $TiO_2$ nanocrystals and simultaneously decreasing the amount of HEC in the fabrication of solid film, the cycling performance can be further enhanced to 30 cycles. Note that the HEC film turned to slightly yellowish after heating at 115° C., leading to a small increase in the intensity of the background absorption.

Controlling the Recoloration Rate

Figure 10:
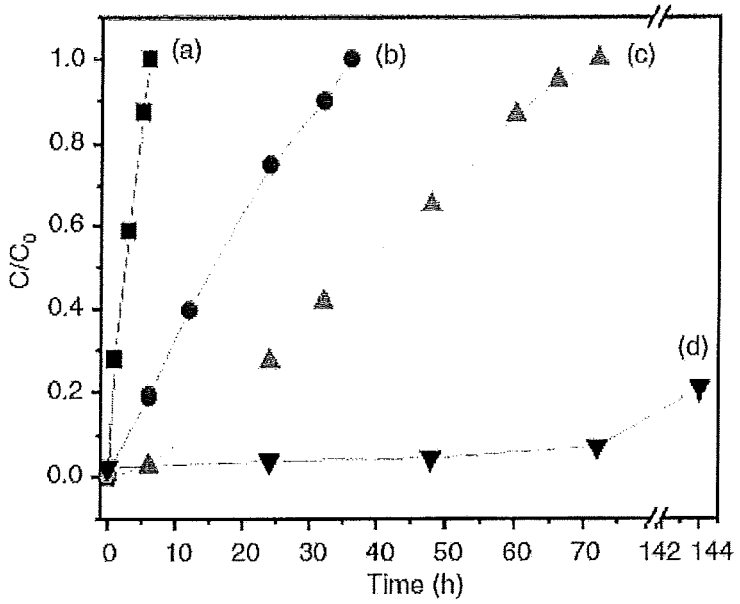
FIG. 10 shows the effect of HEC on recoloration rate, wherein plots of the percent of MB recovered from LMB in solid films by monitoring the absorbance of MB after UV light irradiation as a function of time in ambient air: (a) $TiO_2$ nanocrystals/MB, (b) $TiO_2$ nanocrystals/MB/HEC, (c) $TiO_2$ nanocrystals/MB/HEC with additional HEC film on top surface and (d) $TiO_2$ nanocrystals/MB/HEC solid film with concentration of HEC doubled from the case in (b). When calculating $C/C_0$, the contribution of HEC to the absorption background was subtracted for all samples.

In accordance with an exemplary embodiment, the effect of HEC concentration on the stability of LMB under ambient conditions was explored. As shown in FIG. 10, it was clear that the recoloration process became significantly slower when the concentration of HEC increased in the solid film. In addition to its chemical stabilization effect on LMB, HEC may also contribute to the enhanced stability by partially blocking the diffusion of $O_2$ to LMB through the film. When the concentration of HEC was reduced to half from the case in FIG. 6, the decoloration by UV irradiation can still complete quickly within 1 min. However, recoloration of the film under ambient conditions became faster, and the film color completely recovered after approximately 36 hours sitting in air (FIG. 10). Consistently, the heating temperature required for recoloration can be reduced to 90° C.: only 5 min was needed for complete recoloration when heated in air at this temperature. As indicated in FIG. 10, when the $TiO_2$/MB/HEC film is overcoated with an additional layer of pure HEC, the recoloration can slow down considerably.

High-resolution Photo-printing

The excellent reversibility and repeatability make the $TiO_2$/MB/HEC composite film ideal for use as a rewritable paper. As a demonstration, letters and patterns in the film by UV light irradiation through a photomask were printed, which was pre-produced by ink-jet printing on a plastic transparency (FIG. 11*a*). After UV irradiation for approximately 2 minutes, the exposed regions turned to white, whereas the unexposed regions retained the blue color, replicating letters/patterns from the photomask to the film, as shown in FIG. 11*b*). One of the advantages of the system is the convenience in producing a large-scale film.

Figure 12:
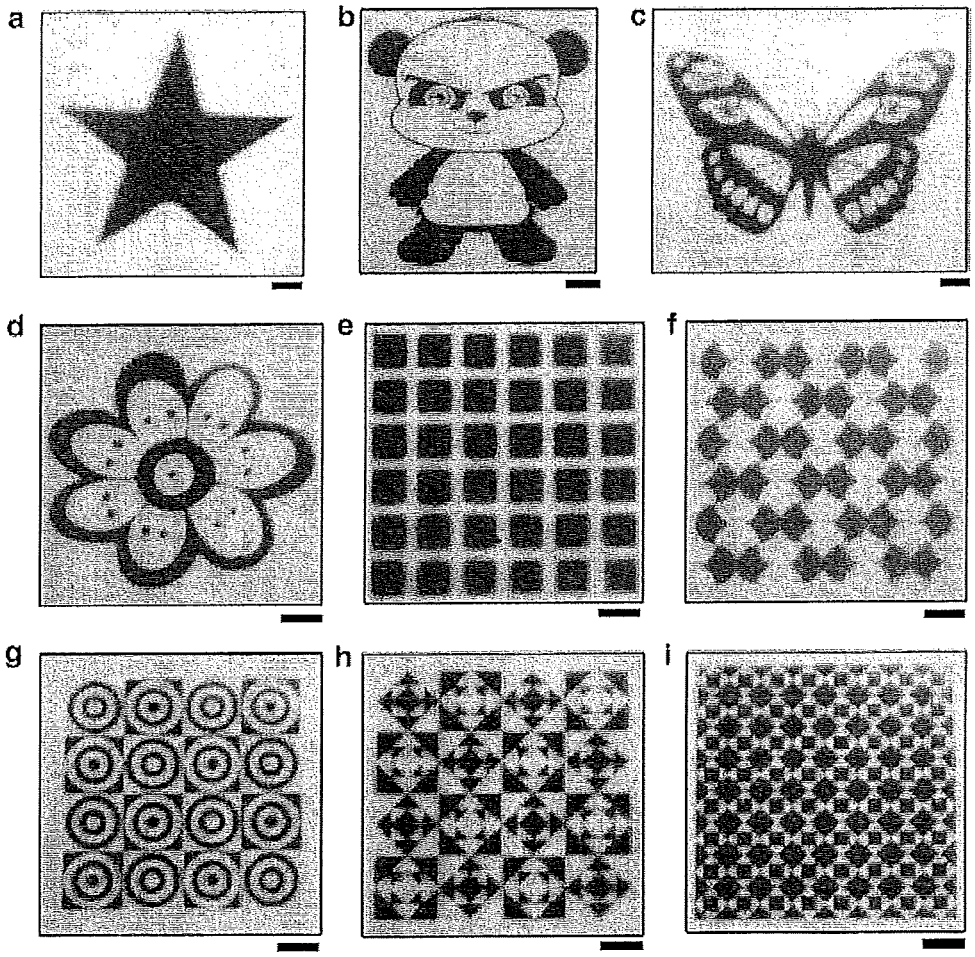
FIG. 12 shows printing complex patterns on the rewritable paper, and wherein the prints were produced after 410 consecutive writing-erasing cycles. Scale bar, 5 mm.
Figure 13:
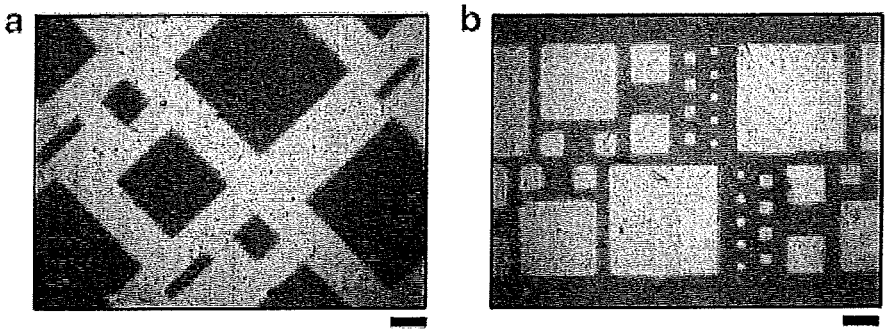
FIG. 13 shows optical microscopy images of photoprinted microscale patterns, and wherein the microscale patterns were photoprinted on a rewritable film using a laboratory 365-nm UV lamp through a chrome photomask. The sharp edges of the microscale patterns demonstrate high-resolution printing. Scale bar, 200 mm.

To demonstrate the practical application, a paragraph of letters on a 5×6.5 $cm^2$ film was printed. As shown in FIG. 11*c*, blue letters of font size 10 with very good resolution could be easily achieved, and they remained highly legible for at least 3 days under ambient conditions (FIGS. 11*d* and 11*e*), which is sufficiently long for most of the temporary reading purposes. In fact, the printed letters were still readable even after 5 days (FIG. 11*f*), although the background gradually turned to light blue. The contrast of the letters started to show apparent decay after 8 days. The prints can be erased completely by heating the rewritable paper at 115° C. in air for approximately 10 min. The slight variation in the background of the printed images was due to the uneven thickness of the film resulted from the manual drop casting. This issue could be resolved by making more uniform films after some practice or by employing more automated processes. In addition, various complicated patterns can also be printed color on the rewritable paper with excellent resolution, as shown in the examples in FIG. 12, which were produced after 410 consecutive writing-erasing cycles. No decrease in color intensity and resolution of the written patterns was observed. In addition to glass substrates, the composite film can also be deposited on plastic substrates and produce a flexible rewritable paper. To demonstrate the high-resolution printing achievable in rewritable paper, microscale patterns were printed through a chrome photomask using again a commercial UV lamp. As shown in the optical microscopy images in FIG. 13, various microscale patterns with sizes from 550 to 35 μm could be successfully photoprinted on the rewritable film. Compared with the patterns on the original photomask, the sharp edges of the photoprinted microscale patterns clearly demonstrate the high resolution achievable in this system.

Photo-printing with Multiple Colored Dyes

Figure 14A:
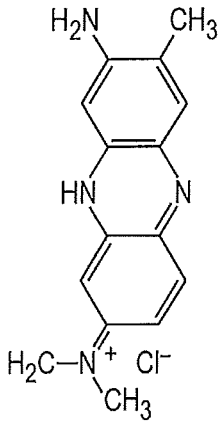
FIG. 14 shows letters photoprinted with RGB colors, wherein the rewritable composite films were fabricated by using (a) neutral red, (b) acid green and (c) methylene blue. Scale bars, 5 mm.
Figure 14B:
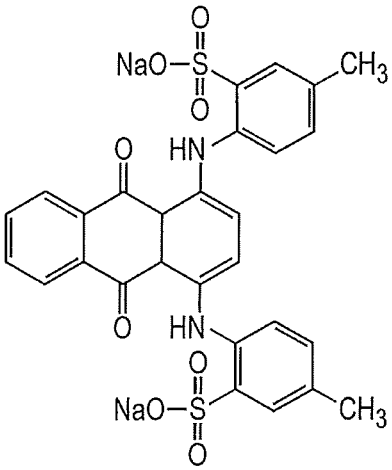
Figure 14C:
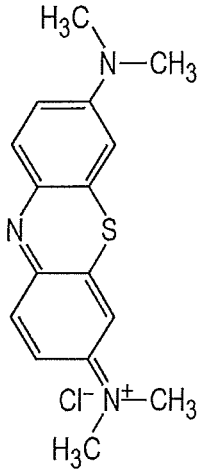

The design principle described in this work allows us to change the working color of rewritable paper by replacing MB with other commercial redox dyes. For example, replacing MB with NR produced a film that can be reversibly switched from red to colorless after UV exposure. Introducing AG to the composite film led to a rewritable paper that can switch from green to light yellow by UV irradiation. FIG. 14 demonstrates the red, green and blue colored letters photoprinted on films containing the three different dyes. In accordance with an exemplary embodiment, a more complete survey of the redox dyes for incorporation into the system could provide more options of working colors for the rewritable paper.

An effective and economic strategy for the development of a new type of rewritable paper is disclosed, in which a commercial redox dye is introduced as the imaging layer. While printing is achieved by photobleaching the dye through UV irradiation with $TiO_2$ nanocrystals as catalysts, erasing is initiated by heating, which significantly promotes the recoloration process through oxidation of the dye by ambient oxygen. The problem of fast recoloration under ambient conditions could be addressed by adding HEC to the system, which not only stabilizes the reduced dye through hydrogen bonding but also blocks oxygen diffusion to the dye. More than 20 printing-erasing cycles have been realized without observable color fading, and the printed letters remain legible with high resolution at ambient conditions for greater than, for example, 3 days, which can be long enough for many practical applications involving temporary reading such as newspapers.

Furthermore, the rewritable paper has advantages over the previously reported versions of rewritable media, including simple paper making process, low production cost, low toxicity and low energy consumption. The rewritable paper is an attractive alternative to a regular paper to address the increasing problems in environment and resource sustainability. In addition, the design principle can be extended to various commercial redox dyes to produce a rewritable paper capable of showing prints of different colors. In accordance with an exemplary embodiment, more elaborate features, such as multicolor printing on the same page, can be realized by controlling the redox reactions of the dyes, for example, by selective photoreduction of the dyes by lights of different wavelengths.

Chemicals

Titanium (IV) chloride ($TiCl_4$), diethylene glycol (DEG), ethylene glycol (EG), poly(ethylene glycol)-b-poly(propylene glycol)-b-poly(ethylene glycol) (P123), ammonium hydroxide ($NH_4OH$), HEC, MB, NR and AG were purchased from Sigma-Aldrich. All other chemical reagents were of analytical grade and used as received without further purification.

Characterization

The absorption spectra of the solid film were measured by a UV-vis spectrophotometer (HR2000CG-UV-NIR, Ocean Optics). The morphology of the nanostructures was investigated using a Philips Tecnai T12 transmission electron microscope at an accelerating voltage of 120 kV. Microscale patterns photoprinted on the rewritable paper were imaged in transmission mode using an Omano OM339P optical microscope.

Synthesis of $TiO_2$ Nanocrystals $TiO_2$ nanocrystals were synthesized using a high-temperature hydrolysis reaction reported previously. A mixture containing $TiCl_4$ (1 ml), P123 (0.6 g), $NH_4OH$ (1 ml), and DEG (20 ml) in a 100-ml flask was heated to approximately 220° C. in air under vigorous stirring, forming a transparent solution. The resulting mixture was kept, for example, at 220° C. for 3 hours and then cooled to room temperature. A light-brown mud-like precipitate was obtained on adding acetone and centrifuging at 11,000 rpm (revolutions per minute) for 10 min. The product was washed several times with ethanol and acetone to remove residuals, and then redispersed in water at concentrations of 10 or 20 mg $ml^{-1}$.

Preparation of Solid Film

An HEC/$H_2O$ stock solution was prepared by dissolving HEC (1.0 g) in $H_2O$ (30 ml) at 65° C. $TiO_2$/$H_2O$ dispersion (20 mg $ml^{-1}$, 4 ml), MB/$H_2O$ solution (0.01 M, 800 ml), HEC/$H_2O$ stock solution (4 ml) and EG (1 ml) were mixed together and sonicated to form a homogenous solution. The solution (approximately 2.5 ml) was drop casted directly on a glass or plastic substrate (50×65 $mm^2$) and then dried in an oven at 80° C. for approximately 12 hours to form a solid blue film. Including a small amount of EG to the mixture solution could improve the smoothness of the solid film. For making a solid film with half concentration of HEC than typical case, a mixture of HEC/H2O stock solution (1 ml), $TiO_2/H_2O$ dispersion (10 mg ml-1, 4 ml), MB/$H_2O$ solution (0.01 M, 400 ml), $H_2O$ (3 ml) and EG (1 ml) was used. In a control experiment, a mixture of HEC/$H_2O$ stock solution (1 ml), EG (1 ml) and $H_2O$ (5 ml) was drop casted on top of the solid composite film to form an additional HEC layer.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A reversible color switching system, comprising:

a printable media; and a reversible color switching medium which is applied to the printable media, the reversible color switching medium comprising:

a redox imaging material;

a photocatalyst, which photocatalyzes the redox imaging material to produce a photocatalytic redox reaction enabling reversible and color switching in response to light irradiation, the photocatalyst being a semiconductor nanoparticle;

a stabilizing material, which stabilizes the reduced redox imaging material; and a surfactant, the surfactant being a capping ligand configured to bind on a surface of the photocatalyst, and wherein the capping ligand acts as a sacrificial electron donor.

2. The color switching system of claim 1, wherein the photocatalyst is selected from the following:

binary metal oxides: $TiO_2$, ZnO, $SnO_2$, $WO_3$, $Nb_2O_5$ and $ZrO_2$; and/or sulfides: CuS, ZnS, CdS, SnS, $WS_2$ and/or $MoS_2$.

3. The color switching system of claim 1, wherein the photocatalyst is titanium oxide ($TiO_2$).

4. The color switching system of claim 1, wherein the image material comprises a redox dye.

5. The color switching system of claim 4, wherein the redox dye is selected from the following:

methylene blue (color of oxidized form: blue and color of reduced form: colorless), methylene green (green and colorless), neutral red (red and colorless), acid green (green and light yellow), safranin T (red-violet and colorless), phenosafranin (red and colorless), indigomono sulfoinic acid (blue and colorless), indigo carmine (blue and colorless), indigotrisulfonic acid (blue and colorless), indigotetrasulfonic acid (blue and colorless), thionine (violet and colorless), sodium o-cresol indophenol (blue and colorless), sodium 2,6-dibromophenol-indophenol (blue and colorless), 2, 2'-bipyridine (Ru complex) (colorless and yellow), 2,2'-bipyridine(Fe complex) (cyan and red), nitrophenanthroline (cyan and red), n-phenylanthranilic acid (violet-red and colorless), 1,10-phenathroline iron(II) sulfate complex (cyan and red), n-ethoxychrysoidine (red and yellow), 5,6-dimethylphenanthroline (Fe complex) (yellow-green and red), o-dianisidine (red and colorless), sodium diphenylamine sulfonate (red-violet and colorless), diphenylbenzidine (violet and colorless), diphenylamine (violet and colorless), and/or viologen (colorless and blue).

6. The color switching system of claim 1, wherein the imaging material comprises a transition metal hexacyanometallates, the transition metal hexacyanometallates including alkali metal ions, alkaline earth ions, ammonium ions, or combinations thereof, and transition metal ions.

7. The color switching system of claim 6, comprising:

water ($H_2O$) within a crystal structure of the transition metal hexacyanometallates of the imaging material.

8. The color switching system of claim 6, wherein the metal hexacyanometallates is Prussian blue.

9. The color switching system of claim 1, wherein the imaging material includes transition metal ions and a photocatalyst.

10. The color switching system of claim 9, wherein the transition metal ions are V, Cr, Mn, Fe, Co, Ni, Cu, Mo, W and/or Ag.

11. The color switching system of claim 1, wherein photocatalyst is a transition metal ion doped with $TiO_2$ nanoparticles.

12. The color switching system of claim 1, wherein the capping ligand contains poly(ethylene glycol)-b-poly(propylene glycol)-b-poly(ethylene glycol).

13. The color switching system of claim 1, wherein the image materials are processed as thin films and/or coatings.

14. The color switching system of claim 1, wherein the stabilizing material is hydroxyethyl cellulose.

15. The color switching system of claim 1, wherein the semiconductor nanoparticles are integrated nanostructures containing the photocatalyst and the sacrificial electron donor.

16. The color switching system of claim 15, wherein the integrated nanostructures have a size of between 5 nm to 500 nm.

* * * * *